US006250731B1

(12) United States Patent
Hashimoto

(10) Patent No.: US 6,250,731 B1
(45) Date of Patent: Jun. 26, 2001

(54) PRINTING APPARATUS WITH DISPLACEABLE CARRIAGE GUIDING MEMBER

(75) Inventor: Kenichirou Hashimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/815,427

(22) Filed: Mar. 11, 1997

(30) Foreign Application Priority Data

| | | |
|---|---|---|
| Mar. 14, 1996 | (JP) | 8-058093 |
| May 1, 1996 | (JP) | 8-110785 |
| Feb. 26, 1997 | (JP) | 9-042503 |

(51) Int. Cl.[7] ..... B61J 2/01; B61J 11/00
(52) U.S. Cl. ..... 347/8; 347/37; 400/56
(58) Field of Search ..... 347/8, 37, 104; 400/59, 56, 57, 636.1, 642, 55; 101/316, 379

(56) References Cited

U.S. PATENT DOCUMENTS

| | | | | |
|---|---|---|---|---|
| 3,990,560 | * | 11/1976 | Pavliscak et al. | 400/56 |
| 4,088,215 | | 5/1978 | Bader | 400/56 |
| 4,692,777 | * | 9/1987 | Hasumi | 347/23 |
| 5,065,169 | * | 11/1991 | Vincent et al. | 347/8 |
| 5,168,291 | | 12/1992 | Hiramatsu et al. | 347/19 |
| 5,172,987 | * | 12/1992 | Stellmach et al. | 400/56 |
| 5,291,224 | | 3/1994 | Asano et al. | 346/134 |
| 5,646,653 | * | 7/1997 | Fujioka et al. | 347/8 |

FOREIGN PATENT DOCUMENTS

| | | | |
|---|---|---|---|
| 0 467 424 | | 1/1992 | (EP) . |
| 0 623 474 | | 11/1994 | (EP) . |
| 0 650 846 | | 5/1995 | (EP) . |
| 2 290 753 | | 1/1996 | (GB) . |
| 3-239844 | | 10/1991 | (JP) . |
| 4-27571 | * | 1/1992 | (JP) 347/8 |

* cited by examiner

*Primary Examiner*—David F. Yockey
(74) *Attorney, Agent, or Firm*—Fitzpatrick, Cella, Harper & Scinto

(57) ABSTRACT

A printer apparatus includes a carriage for moving a printer head in a reciprocal manner, a carriage supporting member for guiding the movement of the carriage by slidably supporting the carriage using a sliding supporting member which slidably supports the carriage, and a displacement portion which is provided to the carriage and is capable of displacement along the surface of the sliding member within a plane which is vertical to the movement direction of the carriage. This arrangement allows stable running of the carriage even if irregularities in height such as offsets exist in the sliding portion of the supporting member which slidably supports the carriage.

26 Claims, 15 Drawing Sheets

PRINTING APPARATUS WITH DISPLACEABLE CARRIAGE GUIDING MEMBER

BACKGROUND OF THE INVENTION

1. Field of the Invention

The present invention relates to a printer apparatus of a construction wherein a carriage supporting member which extends in the reciprocal movement direction of the carriage supports at least a portion of the carriage, and particularly to a printer apparatus which is capable of achieving stable running of the aforementioned carriage.

2. Description of the Related Art

Recently, in accordance with the development of personal computers and the like, there is more demand for printer apparatuses to be of high speed, high resolution, and low cost. Of the printer apparatuses, the ink-jet method, wire dot method, and thermal transfer method are examples of printer apparatuses which are widely used and are of low cost. Particularly, ink-jet type printers are more excellent than the other methods in terms of silence, high speed, a high degree of fine printing, color capabilities, and so forth, and the demand thereof is growing rapidly.

This ink-jet printer apparatus does not press the printing medium directly against the printer head, but arranges the printing surface of the printing medium and the printer head so as to be facing another across a certain distance, and ejects ink droplets from the printer head to certain locations on the printing surface of the printing medium. In other words, with a printer apparatus using such a method, by means of maintaining the distance between the printer head and the printing medium at a proper distance thereafter referred to as "head gap"), ink droplets having a constant dot diameter, concentration, and landing properties can be printed to the printing surface of the printing medium.

In recent years, there is more requirement for printing work which involves printing on printing mediums of various materials and thicknesses. The aforementioned head gap changes according to such difference in thickness of printing medium, and thus it is becoming difficult to maintain quality at a constant.

In order to deal with this, for example, Japanese Unexamined Patent Publication No. 3-239844 discloses an arrangement wherein the printing medium is pressed against a transporting roller located upstream from the platen by means of a medium pressing plate, and causing a carriage mounted with the printer head to perform scanning motion in accordance with this medium pressing plate, so that the head-gap is automatically corrected in accordance with the change in thickness of the printing medium.

FIG. 1 shows an example of such a known printer apparatus. Here, directly underneath a platen 1, which is in the form of a plate, is a rotationally driving transporting roller 2, and the printing medium 5 is pressed against the transporting roller 2 by means of a medium pressing plate 3 which is aided by this transporting roller 2 and a pinch roller 4 which is rotatably attached unto this medium pressing plate 3, thus feeding the printing medium 5 out to the side of the platen 1. Also, rotatably attached to a guide shaft 6 which is parallel to the transporting roller 2 is a carriage 8 mounted with a printer head 7, and is arranged such that the carriage 8 performs scanning motion with the printer head 7 following the guide shaft 6. The carriage 8 is in a state of the end thereof being pressed against the medium pressing plate 3 due to its own weight, and thus slides along the medium pressing plate 3. However, the spacing between the medium pressing plate 3 and the transporting roller 2 changes according to change in the thickness of the medium 5, and thus the head gap between the printing surface of the printing medium and the printer head 7 is constantly maintained the same, regardless of the thickness of the printing medium 5.

In the printer apparatus shown in FIG. 1, in the event that the medium pressing plate 3 is formed of a single material, irregularities occur in the pressure applied by the medium pressing plate 3 to the printing medium 5 if there is the slightest bit of bowing or deformation of this medium pressing plate 3 or eccentricity of the transporting roller 2, thus giving rise to incidents such as inhibiting maintaining of the transporting pitch of the printing medium 5 at a constant or the printing medium becoming crooked as to the correct transporting direction.

Accordingly, thought has been given to making the medium pressing plate 3 easily flexible in the direction of the printing medium 5, or separating the medium pressing plate 3 into several parts along a width direction of the printing medium 5. However, in the event that the medium pressing plate 3 is made to be easily flexible in the direction of the printing medium 5, or separated into several parts along the width direction of the printing medium 5, while the transporting precision of the printing medium 5 does improve, an offset occurs between the portion where the printing medium 5 exists between the transporting roller 2 and the medium pressing plate 3 and where it does not exist between these members, as can be understood from FIG. 2 which illustrates the operational concepts of the medium pressing plate 3 in this case. Thus, when the carriage 8 moves from the right side toward the-left side, for example, in the Figure, the carriage 8 becomes hung on this offset portion 9, changing the sliding resistance of the carriage 8 as to the guide shaft 6, causing temporary irregularities in the running precision of the carriage 8 after passing over the offset portion 9, which has been a problem.

SUMMARY OF THE INVENTION

An object of the present invention is to provide a printer apparatus wherein stable running of the carriage can be achieved even if there are irregularities in height in the sliding portion of the supporting member which slidably supports the carriage, this member being provided along the direction of motion of the carriage.

Another object of the present invention is to provide a printer apparatus wherein there is no irregularity in carriage running precision even if there is an offset between the portion where the printing medium exists between the printing medium supporting member and the printing medium pressing member, and where the printing medium does not exist between these members.

A further object of the present invention is to provide a printer apparatus wherein, even in the case where the printing medium pressing member has been constructed so as to be easily flexible in the width direction of the printing medium in order to make the pressure from the printing medium pressing member to the printing medium uniform, the sliding portion of the carriage has been made so as to displace in accordance with the surface form of the printing medium pressing member, so that even if there is existence of fine undulations on the surface of the printing medium pressing member the amplitude thereof is reduced, and the shock of riding up on the offset portion generated on the surface of the printing medium pressing member based on the edge of the printing medium is weakened, thus allowing for the scanning precision of the carriage to be maintained favorably.

Also, it is another object of the present invention to provide a printer apparatus wherein the sliding portion displaces in accordance with the surface state of the printing medium pressing member, and the sliding portion is maintained in a state of being in contact with the printing medium pressing member, thus inhibiting change in the contact plane pressure of the sliding portion against the printing medium pressing member.

Further, it is another object of the present invention to provide a printer apparatus, comprising: a carriage for reciprocally moving a printer head; a carriage supporting member which slidably supports the aforementioned carriage by means of a sliding supporting portion which slidably supports the aforementioned carriage and which guides the movement of the aforementioned carriage; and a displacement portion which is capable of displacement along the surface of the aforementioned sliding portion which is a plane vertical to the direction of movement of the aforementioned carriage; thus achieving stable running of the carriage even if there are irregularities in height in the sliding portion of the supporting member which slidably supports the aforementioned carriage, this member being provided along the direction of motion of the carriage.

Moreover, it is another object of the present invention to provide a printer apparatus comprising: a printing medium supporting member which supports the printing medium; a printing medium pressing member which is provided across from and opposing this printing medium supporting member so as to be changeable in position and pressed toward the aforementioned printing medium supporting member so as to press the aforementioned printing medium against the printing medium supporting member; a carriage which scans in the width direction of the aforementioned printing medium maintained between the aforementioned printing medium supporting member the aforementioned printing medium pressing member, and which is provided movably in the direction opposing the aforementioned printing medium supporting member and pressed to the side of the aforementioned printing medium pressing member so as to have one end thereof pressed against the surface of the aforementioned printing medium pressing member to the opposite side of the aforementioned printing medium supporting member; and a sliding portion which is provided to the aforementioned one end of this carriage and is in contact slidably with the aforementioned surface of the aforementioned printing medium pressing member, and wherein both ends of the sliding portion are displaceable to said carriage in accordance with said surface form of said printing medium supporting member.

DESCRIPTION OF THE PREFERRED EMBODIMENTS

The following is a description of an embodiment of the printer apparatus according to the present invention applied to an ink-jet printer, with reference to the Figures. In regard to this, it should be understood that it is needless to say that the present invention can be applied to other printer apparatuses of a construction wherein a carriage supporting member which extends in the reciprocal movement direction of the carriage supports at least a portion of the carriage, besides the present ink-jet printer apparatus.

Figure 1:
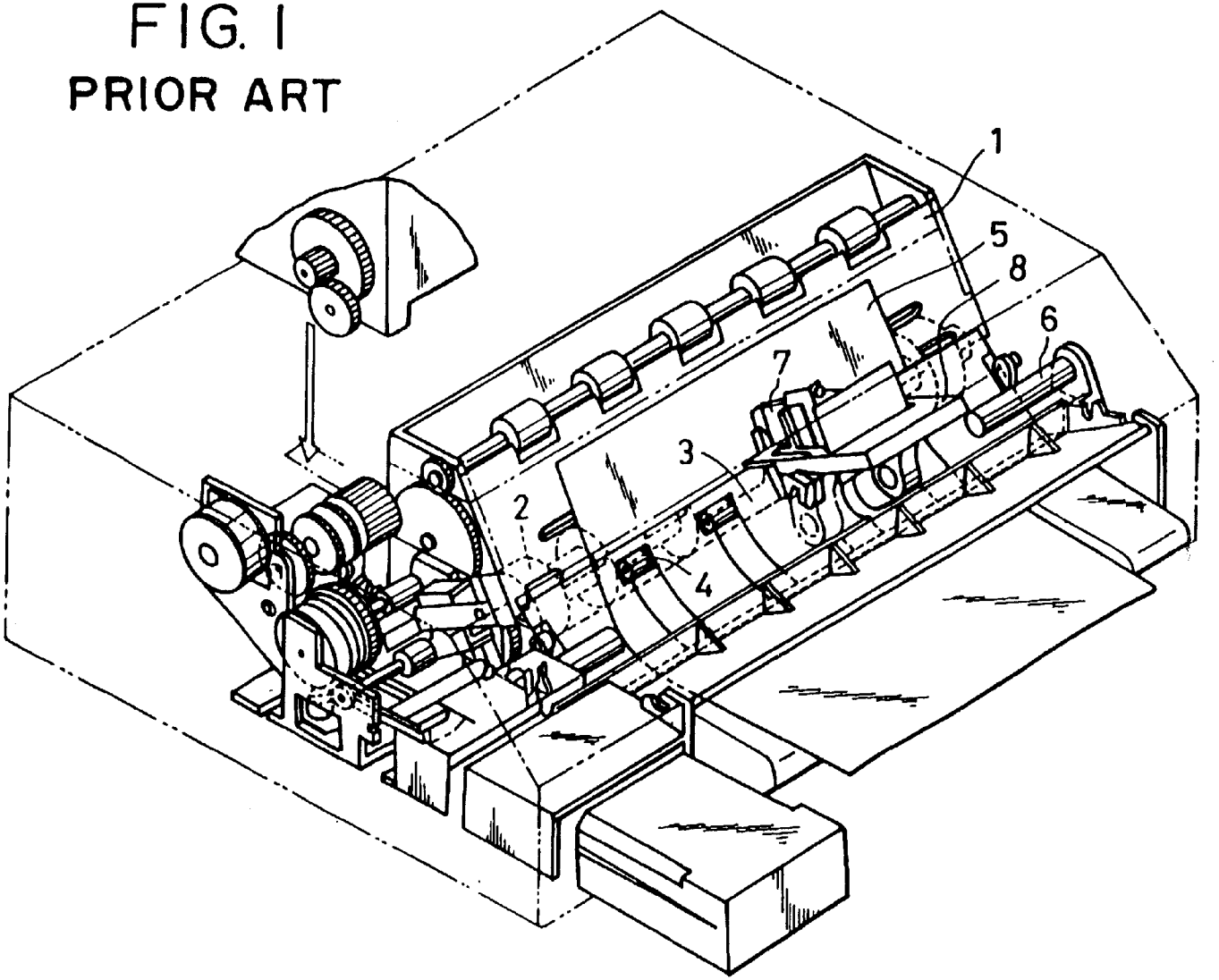
FIG. 1 PRIOR ART
FIG. 1 is a perspective view of the exterior of a known printer apparatus.
Figure 2:
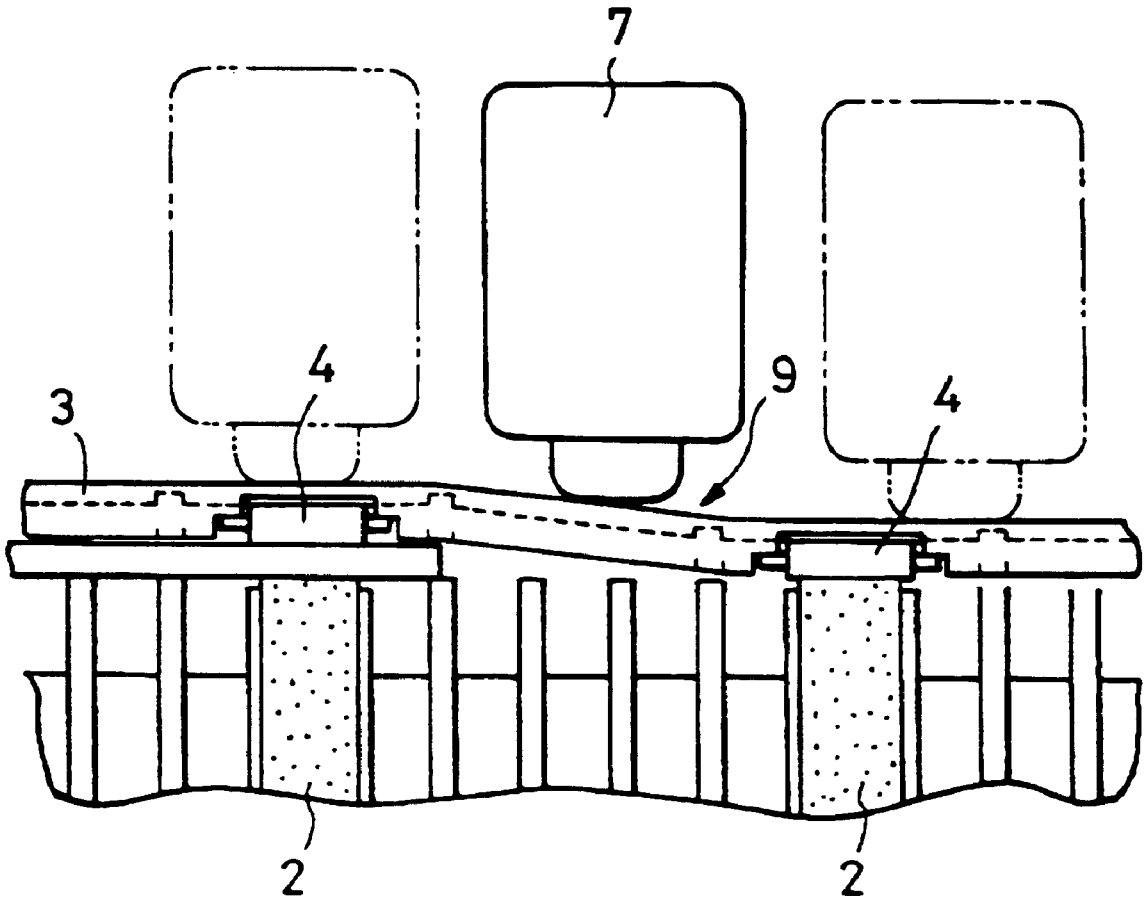
FIG. 2 PRIOR ART
FIG. 2 is a operational conceptual diagram illustrating the scanning path of the carriage of the printer apparatus shown in FIG. 1.
Figure 3:
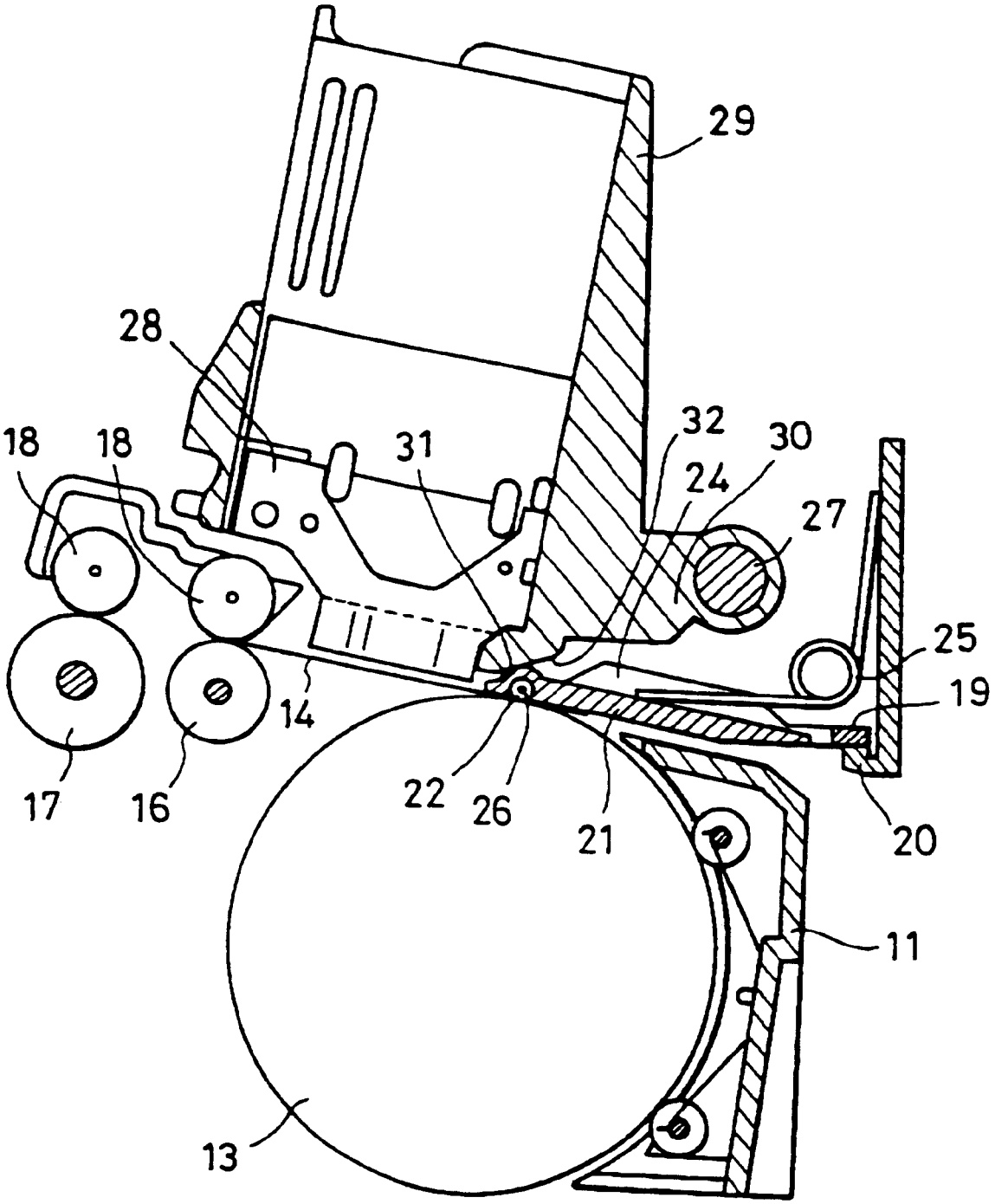
FIG. 3 is a cross-sectional view schematically illustrating the construction of the principal members of a printer apparatus according to an embodiment of the present invention.
Figure 4:
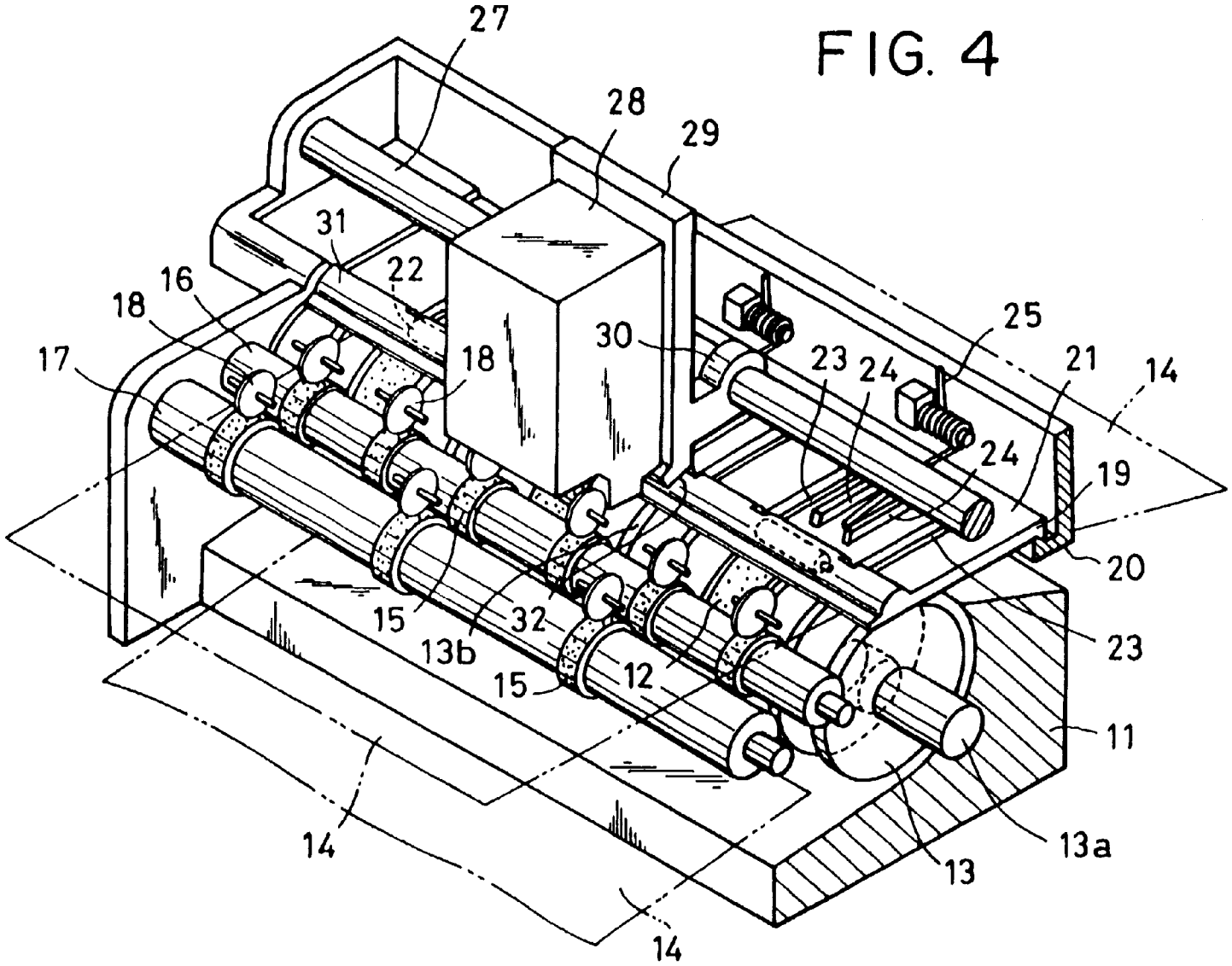
FIG. 4 is a perspective view of the exterior of the embodiment of the printer apparatus shown in FIG. 3.

As can be seen from FIG. 3 which schematically illustrates the construction of the principal members of an ink-jet printer apparatus according to the present embodiment, and FIG. 4 which illustrates the overall exterior view, attached to casing 11 is a shaft 13*a* of the central portion, a plurality of round plates 14 which are integrally formed with this shaft 13*a*, and-a transporting roller 13 upon the outer circumference of which are provided a plurality of rubber rollers 12, this transporting roller 13 being provided such that both ends are attached so as to be driven rotatably. The transporting roller 13 in the present embodiment is arranged so as to the reverse the direction of the printing paper 14 by 180° from the lower side of the casing 11 and transport the printing paper 14 to the upper side of the casing 11, or to transport the printing paper 14 from the rear side of the casing 11 toward the front side of the casing 11 in a generally horizontally maintained state.

Also, downstream from this transporting roller 13 are bi-level paper ejecting rollers 16 and 17, each having a plurality of rubber rollers 15 formed upon the outer circumference thereof, and each rotatably attached to the casing 11 so as to rotate synchronously with the rotation of the transporting roller 13. Above the rubber roller portions 15 of each of the paper ejecting rollers 16 and 17 are rotatably provided movable spurs 18 opposing the rubber roller portions 15, each being pressed against the rubber roller portions 15 by means of pressing means (not shown) so as to each pinch the printing paper 14 being fed out from the transporting roller 13 with the paper ejecting rollers 16 and 17.

Between the aforementioned transporting roller 13 and the paper ejecting roller 16 which is on the side adjacent to this transporting roller 13 is a plate-shaped platen (not shown) which guides the printing paper 14 being fed from the transporting roller 13 to the paper ejecting roller 16 side.

On the other hand, provided above the transporting roller 13 is a paper pressing plate 21 which is retained at a retaining portion 20 formed on the casing 11 by a catching portion 19 formed on the base edge portion, with the leading edge of the paper pressing plate 21 being capable of coming into contact with the topmost edge of the transporting roller 13, this paper pressing plate 21 being capable of displacement up and down with the tip thereof centered on this catching portion 19. Also, respectively rotatably provided to the rubber roller portions 12 of the transporting roller 13 and the corresponding opposing paper pressing plate are a plurality of pressing rollers 22 (three in the Figure) for reducing the sliding resistance of the paper pressing plate 21 against the printing paper 14 and thus facilitating smooth transporting of the printing paper 14. Further, this paper pressing plate 21 is constructed of a flexible material such as plastic or the like, and is provided with a plurality of cutouts 23 extending from the base edge side toward the leading edge so as to surround each of the pressing rollers 22. Between each of the cutouts 23 are provided a plurality of ribs 24 (two in the Figure) parallel to the cutouts 23, for increasing the rigidity of the portions of the paper pressing plate 21 where the pressing rollers 22 are attached, and torsion coil springs 25 for pressing the leading edge of the paper pressing plate 21 toward the side of the transporting roller 13 are provided in a number corresponding to the number of pressing rollers 22 and are each attached to the upper side of the retaining portion 20 of the casing 11 with one side thereof coming into contact with the paper pressing plate 21 between adjacent ribs 24.

Thus, the shaft 26 of the pressing rollers 22 opposing the transporting roller 13 is constantly maintained parallel thereto, pressing the pressing rollers 22 against the transporting roller 13 with even pressure, thereby changing the rotational position of the paper pressing plate 21 according to the thickness of the printing paper 14.

Above the aforementioned paper pressing plate 21 is provided a guide shaft 27 with a round cross-sectional form, this being provided parallel with the transporting roller 13, and with both ends being supported by the casing 11. Also, protruding from the-carriage 29 which detachably supports a printer head 28 so as to oppose the printing surface of the printing paper 14 on the platen, are a pair of brackets 30 which protrude to the side to the guide shaft 27 and allow the guide shaft 27 to pass slidably through. Further, a toothed belt (not shown) is linked to the carriage 29 in a manner generally parallel to the guide shaft 27, and by means of driving this toothed belt by means of a stepping motor (not shown), the printer head 28 is subjected to scanning motion in the width direction of the printing paper 14 along the guide shaft 27.

The plane opposite to the pressing rollers 22 of the paper pressing plate 21 is an arc plane 31 coaxial with the shaft 26 of the pressing rollers 22, and the bottom edge of the carriage 29 slidably makes contact following this arc plane 31. Formed to the bottom of this carriage 29 is a slanted plane 32 of an inclination of, e.g., around 30°, so as to be parallel to the shaft 26 of the pressing rollers 22, and also facing the printing surface of the printing paper 14 which opposes the printer head 28. The slanted plane 32 which serves as the sliding portion of the present invention is inclined such that a plane extend therefrom intersects the printing surface of the printing paper 14 which is located between the paper ejecting roller 16 and the pressing rollers 22.

Also, since the carriage 29 is rotatably linked to the guide shaft 27, rotation moment occurs due to the weight of the carriage 29 and printer head 28, and the lower edge of the printer head 28 rotates so as to approach the platen. As a result, the slanted plane 32 of the carriage 29 comes into contact with the arc plane 31 of the paper pressing plate 21, and thus the head gap between the printing surface of the printing paper 14 and the printer head 28 is maintained so as to be practically constant.

Accordingly, when conducting work to the printing paper 14, the printing paper 14 is pinched between the transporting roller 13 and pressing rollers 22 of the paper pressing plate 21, via either a horizontal path from behind the casing 11 or a U-turn path from the front bottom side. When the printer paper 14 is pinched between the transporting roller 13 and the paper pressing plate 21, the paper pressing plate 21 is raised by an amount corresponding to the thickness of the printing paper 14, and simultaneously the carriage 29 is also rotated upward so that the head gap between the printing surface of the printing paper 14 and the printer head 28 is maintained so as to be practically constant. When the printing paper 14 is transported to a platen (not shown), the carriage 29 scans in the direction of the width of the printing paper 14 and ink is ejected from the printer head 28, thus printing one line. Subsequently, intermittent feeding of the printing paper 14 and scanning motion of the carriage 29 are repeated, and the predetermined information is printed on the printing surface of the printing paper 14. Following printing, the printing paper 14 is pinched between the paper ejecting rollers 16 and 17 by means of spurs 18, so as not to soil the printing surface, and is ejected out from the casing 11.

In this way, by means of inclining the slanted plane 32 of the carriage 29 coming into contact with the arc plane 31 of the paper pressing plate 21 against the printing surface of the printing paper 14 opposing the printer head 28 in this mutually opposing arrangement, the paper pressing plate 21 rotates around the catching portion 19 so that contact position of the arc plane 31 of the paper pressing plate 21 as opposed to the slanted plane 32 of the carriage 29 shifts toward the direction of intersection with the shaft 26 of the pressing rollers 22. As a result, the amount of displacement of the slanted plane 32 of the carriage 29 centered around the guide shaft 27 becomes relatively less than the amount of displacement of the pressing rollers 22 of the paper pressing plate 21, thus controlling the ratio of change of the head gap between the printer head 28 and the printing surface of the printing paper 14 regarding the amount of rotation of the paper pressing plate 21.

Figure 7:
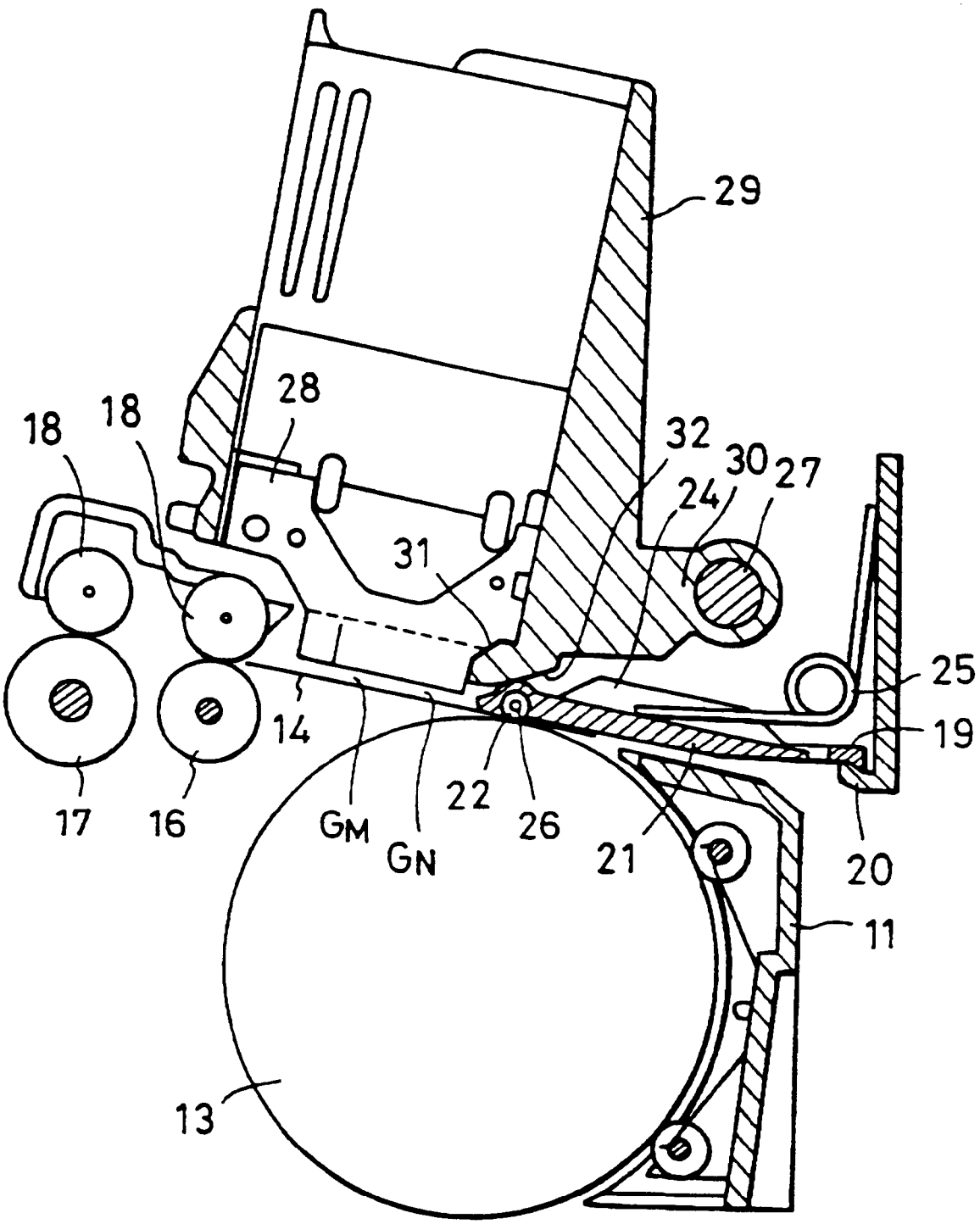
FIG. 7 is a cross-sectional diagram illustrating a situation wherein thick printing medium has been supplied to the printing apparatus shown in FIG. 3.

More specifically, as shown in FIG. 3, an arrangement was prepared wherein the slanted plane 32 of the carriage 29 was inclined by 30° as to the printing surface of the printing paper 14 which is opposing the printer head 28, and adjusted so that the head gap would be 1.39 mm across the entire range of the printer head 28 in the event that the thickness of the printing paper 14 is 0.05 mm in thickness. Then, printing paper 14 of 0.5 mm in thickness was supplied thereto, and as shown in FIG. 7 which illustrates this state, it was found that the maximum head gap $G_M$ was 1.54 mm, and the minimum head gap $G_N$ was 1.41 mm, well within the permissible margin of error, even if the permissible margin of error is set at, e.g., 19%.

Figure 5:
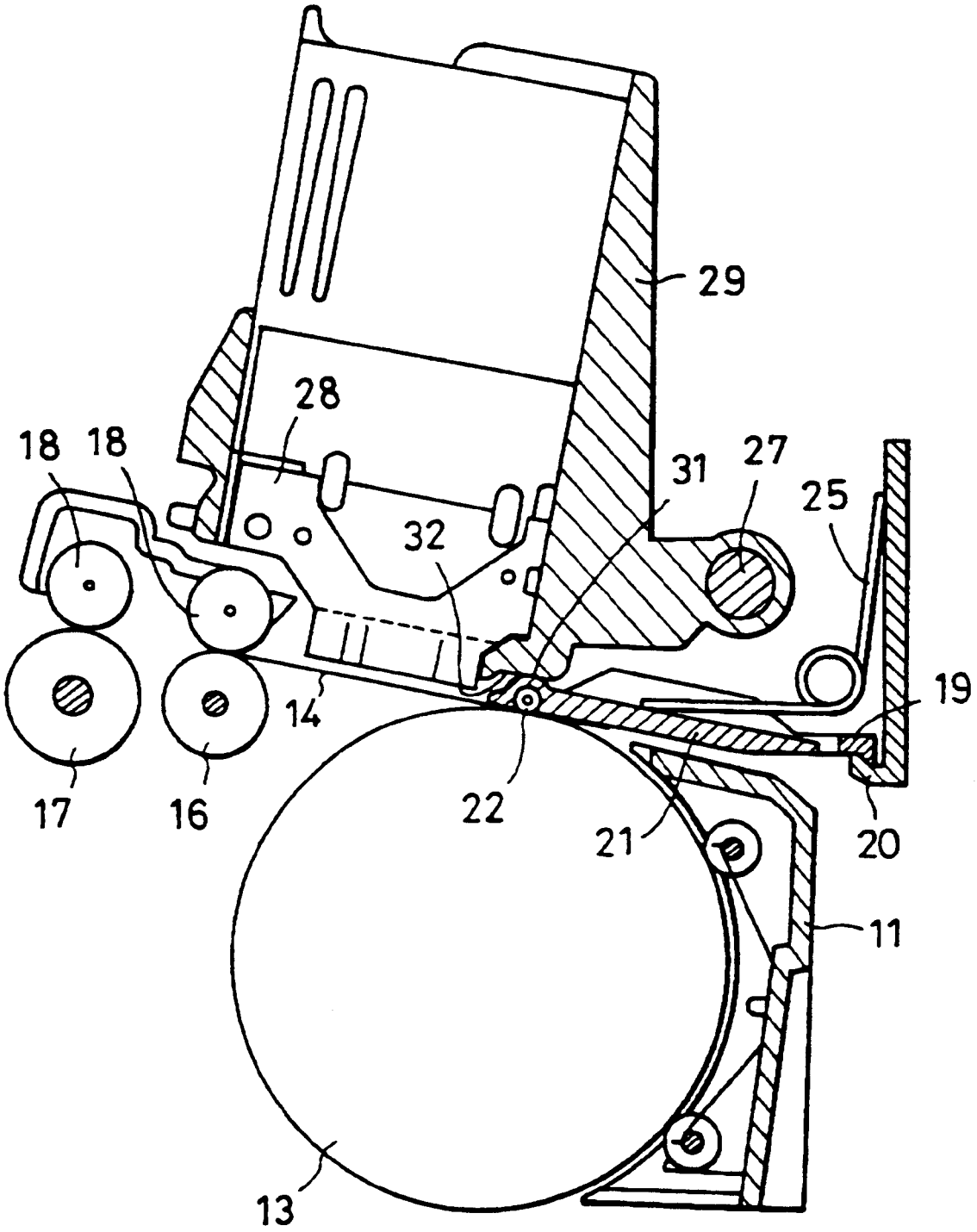
FIG. 5 PRIOR ART
FIG. 5 is a cross-sectional view schematically illustrating the construction of the principal members of a known printer apparatus corresponding to the embodiment of the present invention as shown in FIG. 3.
Figure 6:
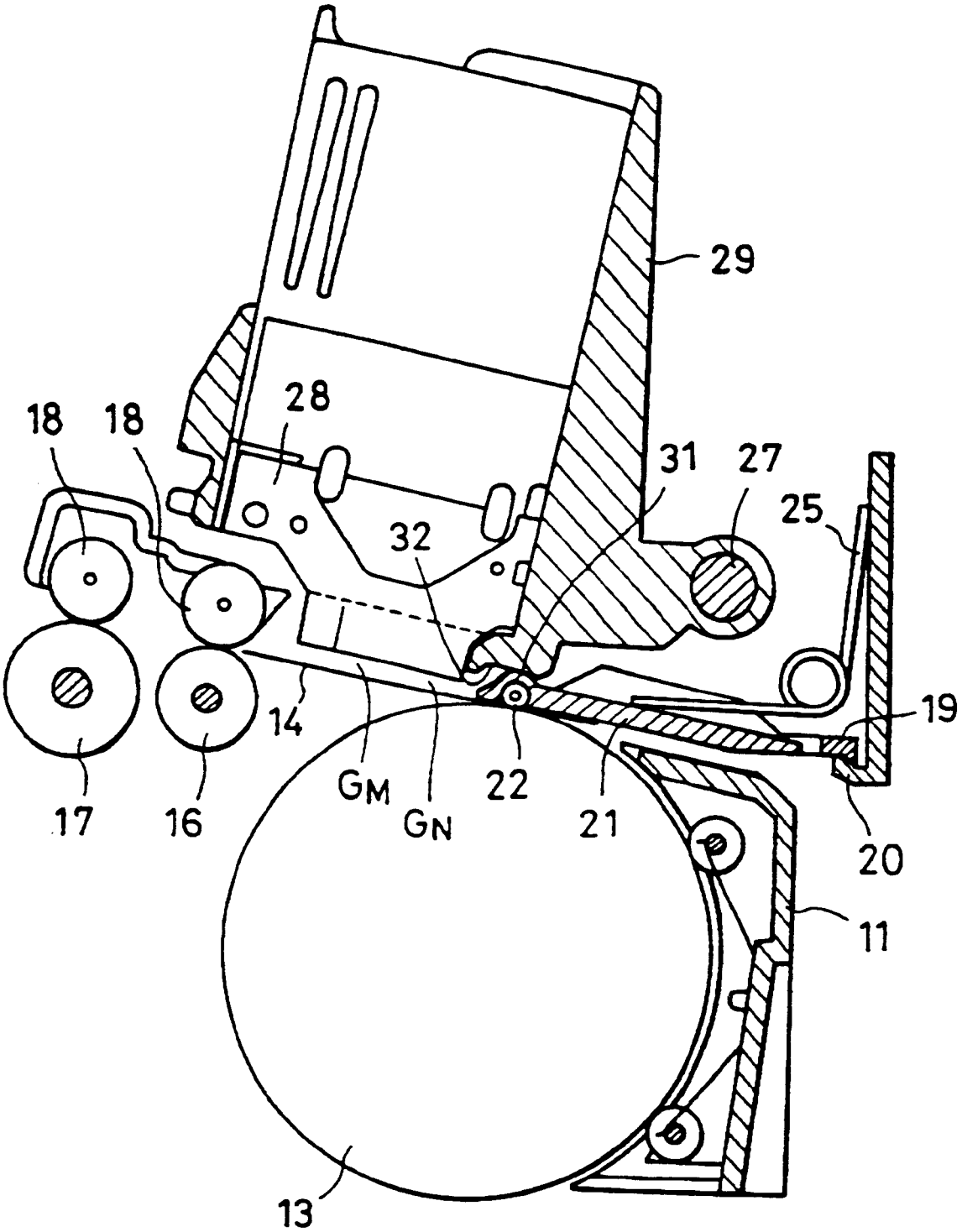
FIG. 6 PRIOR ART
FIG. 6 is a cross-sectional diagram illustrating a situation wherein thick printing medium has been supplied to the printing apparatus shown in FIG. 5.

On the other hand, as shown in FIG. 5, an arrangement was prepared wherein the slanted plane 32 of the carriage 29 coming into contact with the arc plane 31 of the paper pressing plate 21 was set so as to be parallel with the printing surface of the printing paper 14 which is opposing the printer head 28, and adjusted so that the head gap would be 1.39 mm across the entire range of the printer head 28 in the event that the thickness of the printing paper 14 is 0.05 mm in thickness. Then, printing paper 14 of 0.5 mm in thickness was supplied thereto, and as shown in FIG. 6 which illustrates this state, it was found that not only the maximum head gap $G_M$ was 2.07 mm, the minimum head gap $G_N$ also was 1.83 mm, greatly exceeding the permissible margin of error for the head gap.

With the above-described embodiment, the head gap is determined at a single value at the assembly stage of the ink-jet printer, but the apparatus may be provided with fine adjustment functions of the head gap.

Figure 8:
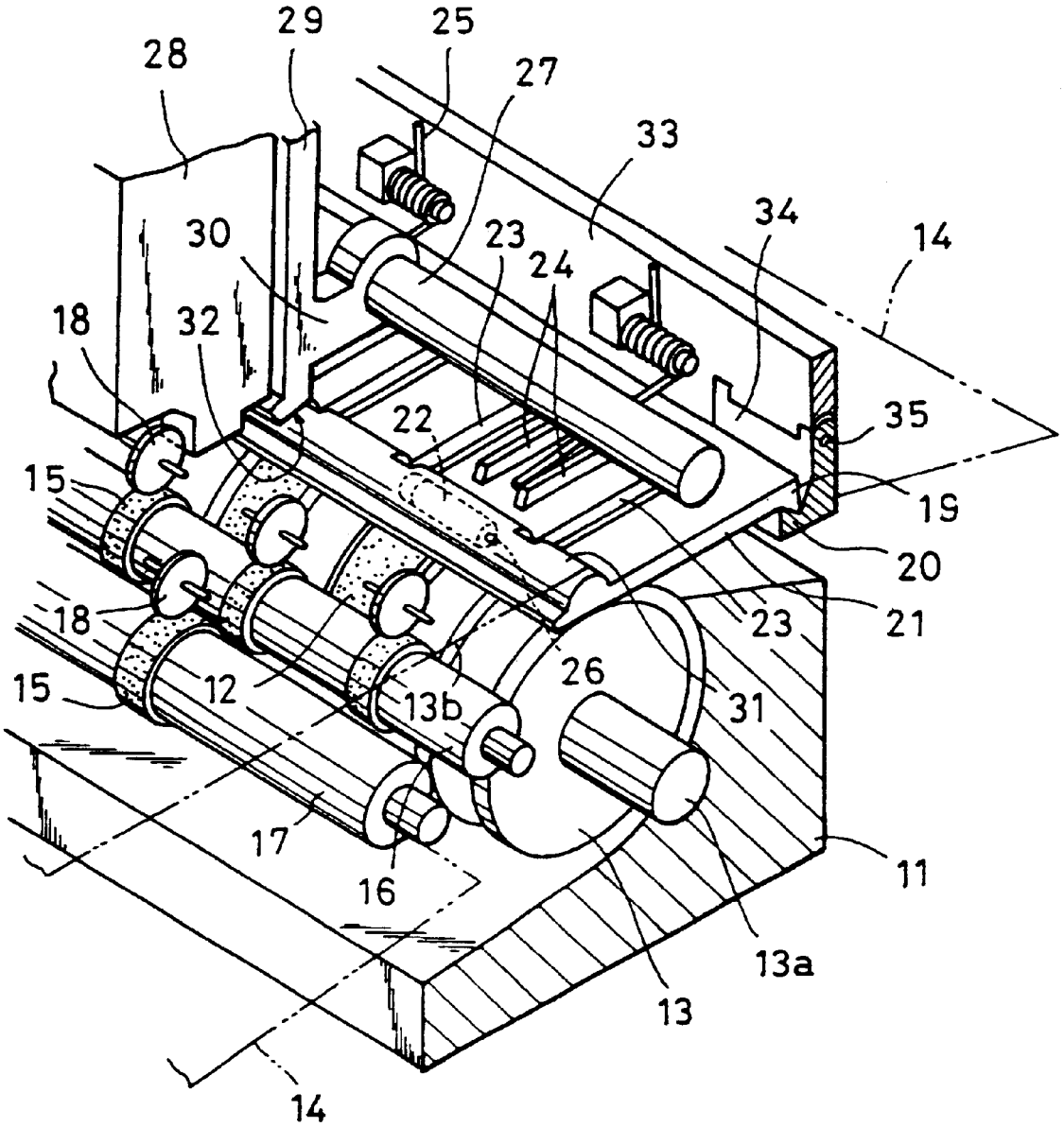
FIG. 8 is a perspective view of the exterior of an extracted portion of another embodiment relating to the present invention.
Figure 9:
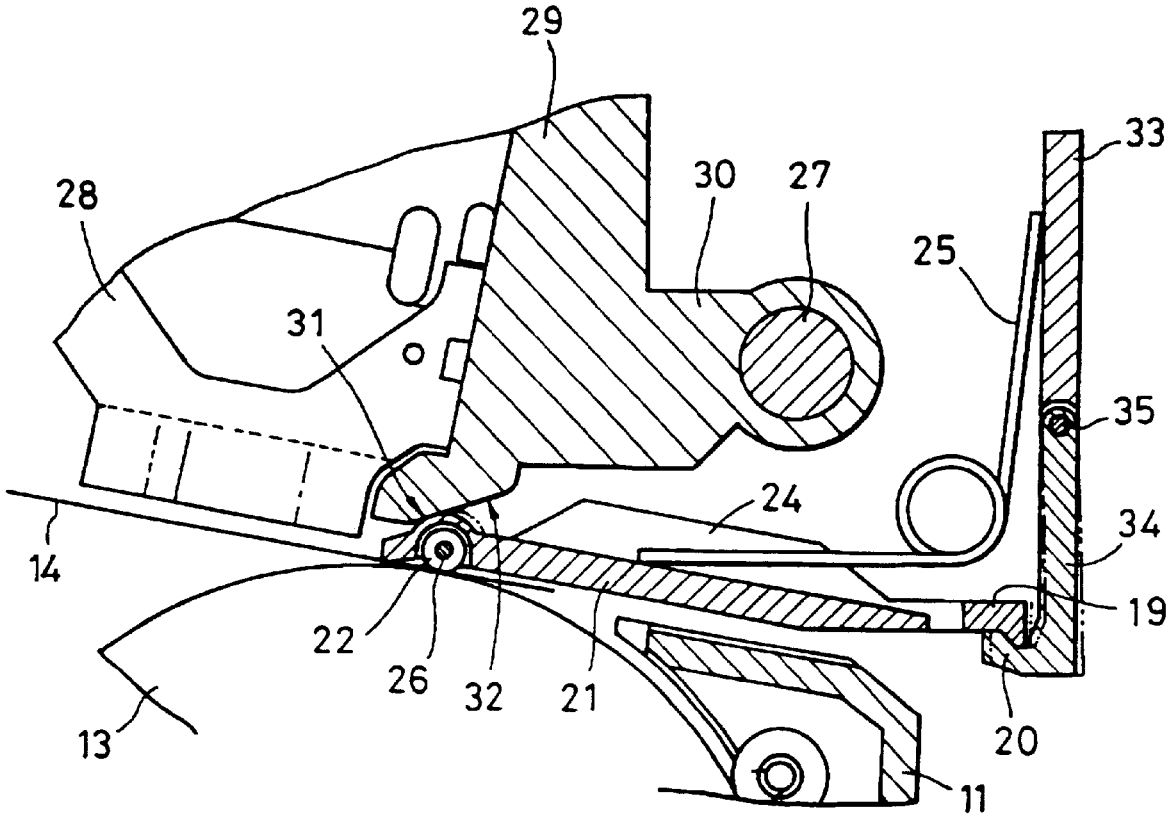
FIG. 9 is a cut-away cross-sectional diagram illustrating the construction of the principal members of a printer apparatus according to the embodiment shown in FIG. 8.

The exterior view of the principal components of another embodiment is shown in FIG. 8 and an enlarged cross-sectional structural drawing is illustrated in FIG. 9. The members which are of the same function as those of the earlier embodiment are denoted by the same reference numerals, and redundant description thereof will be omitted. Rotatably attached to the rear wall portion 33 of the casing 11 which opposes the rear end portion of the paper pressing plate 21 are adjustment plates 34 with a trench-shaped retaining portion 20 formed to the bottom thereof, this rotational attachment being conducted via a pin 35 parallel to the guide shaft 27 passing through the upper portion of the adjustment plates 34. In the present embodiment, there are provided one each of the adjustment plates 34 to either longitudinal end portion of the guide shaft 27.

Accordingly, by means of rotating the right and left adjustment plates 34 centrally around the pin 35, the paper pressing plate 21 moves to the right and left directions in FIG. 9 via the catching portion 19, so that the slanted plane 32 of the carriage 29 which comes into contact with the arc plane 31 of the paper pressing plate 21 rotates centrally around the guide shaft 27, so that the head gap between the printing paper 14 and the printer head 28 changes. In the event wherein the inclination of the slanted plane 32 of the carriage 29 is set to be 30° as to the printing surface of the printing paper 14 opposing the printer head.28, the head gap can be corrected by 0.3 mm by means of shifting the retaining portion 20 by 1 mm.

This head gap adjustment can be conducted at any time, even in cases where the head gap has changed due to wearing or the like.

In the above-described two embodiments, a slanted plane 32 was formed to the bottom of the carriage 29 and the leading edge portion of the paper pressing plate 21 against which this slanted plane 32 slidably contacts was made to be an arc plane 31, but these may be reversed.

Figure 10:
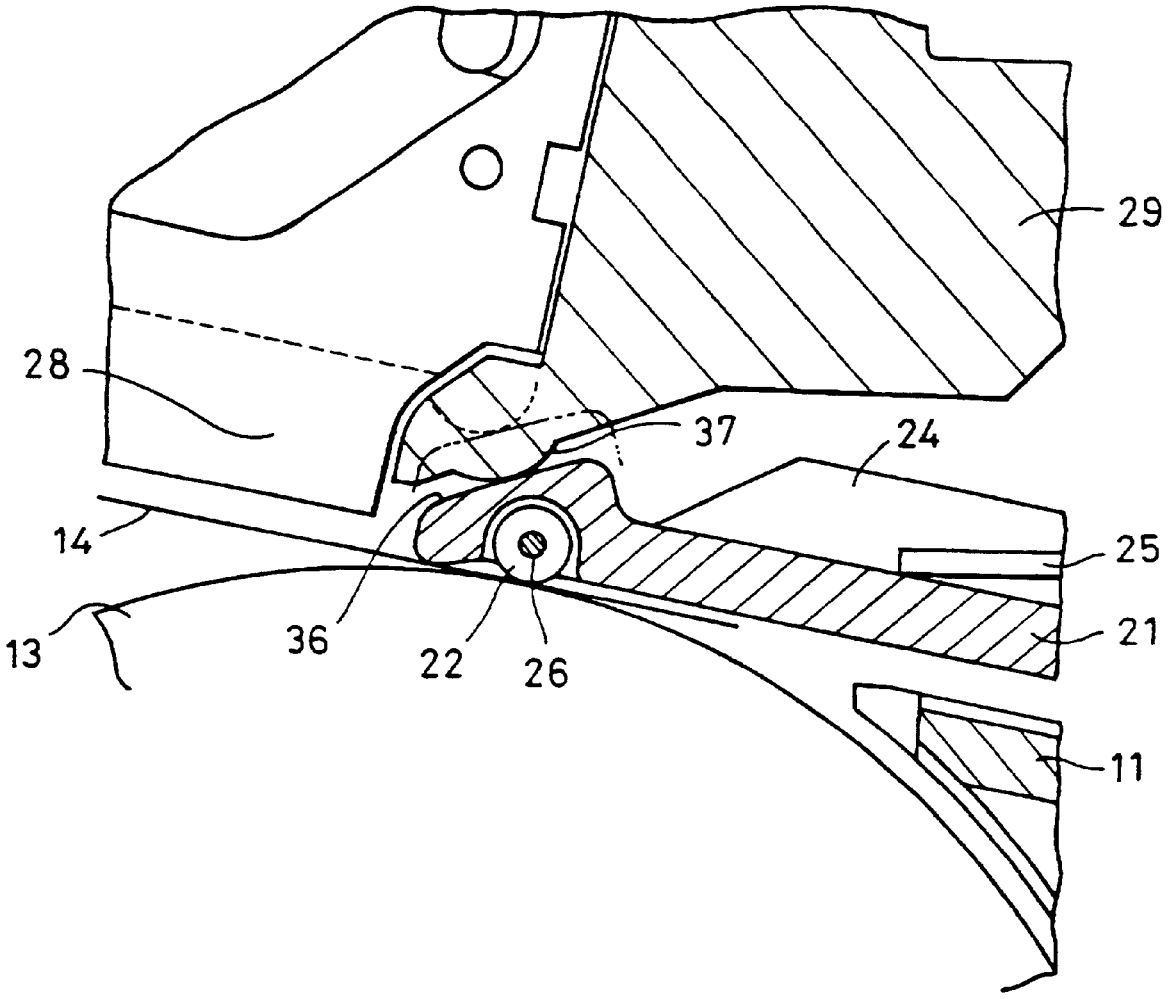
FIG. 10 is a cross-sectional diagram illustrating the construction of the principal members of a printer apparatus according to another embodiment of the present invention.

A cross-sectional structural drawing of the principal components of yet another embodiment of such an invention is illustrated in FIG. 10 The members which are of the same function as those of the earlier embodiments are denoted by the same reference numerals, and redundant description thereof will be omitted. The plane opposite to the pressing rollers 22 of the leading edge of the paper pressing plate 21 is parallel with the shaft 26 of the pressing rollers 22, and also forms a slanted plane 36 which is at an inclination of e.g., 30°, as opposed to the printing surface of the printing paper 14 which is opposing the printer head 28, such that the bottom edge of the carriage 29 slidably comes into contact along this slanted plane 36. The slanted plane 36 in the present invention is inclined such that a plane extend therefrom intersects the printing surface of the printing paper 14 which is located between the paper ejecting roller 16 and the pressing rollers 22, but there is no problem with the inclination being reversed.

Also, a convex arc plane 37 protruding to the side of the slanted plane 36 and having an axial line parallel to the shaft 26 of the pressing rollers 22 as the center thereof is formed to the bottom of the carriage 29, so that this convex arc plane 37 serves as the sliding portion in the present invention.

As described above, by means of causing the slanted plane 36 of the paper pressing plate 21 coming into contact with the arc plane 37 of the carriage 29 to be inclined as to the printing surface of the printing paper 14 which opposes the printing head 28, the paper pressing plate 21 rotates around the catching portion 19 so that the contact position of the arc plane 37 of the of the carriage 29 as opposed to the slanted plane 36 of the paper pressing plate 21 shifts toward the direction of intersection with the shaft 26 of the pressing rollers 22. As a result, the amount of displacement of the arc plane 37 of the carriage 29 centered around the guide shaft 27 becomes relatively less than the amount of displacement of the pressing rollers 22 of the paper pressing plate 21, thus controlling the ratio of change of the head gap between the printer head 28 and the printing surface of the printing paper 14 regarding the amount of rotation of the paper pressing plate 21.

Figure 11:
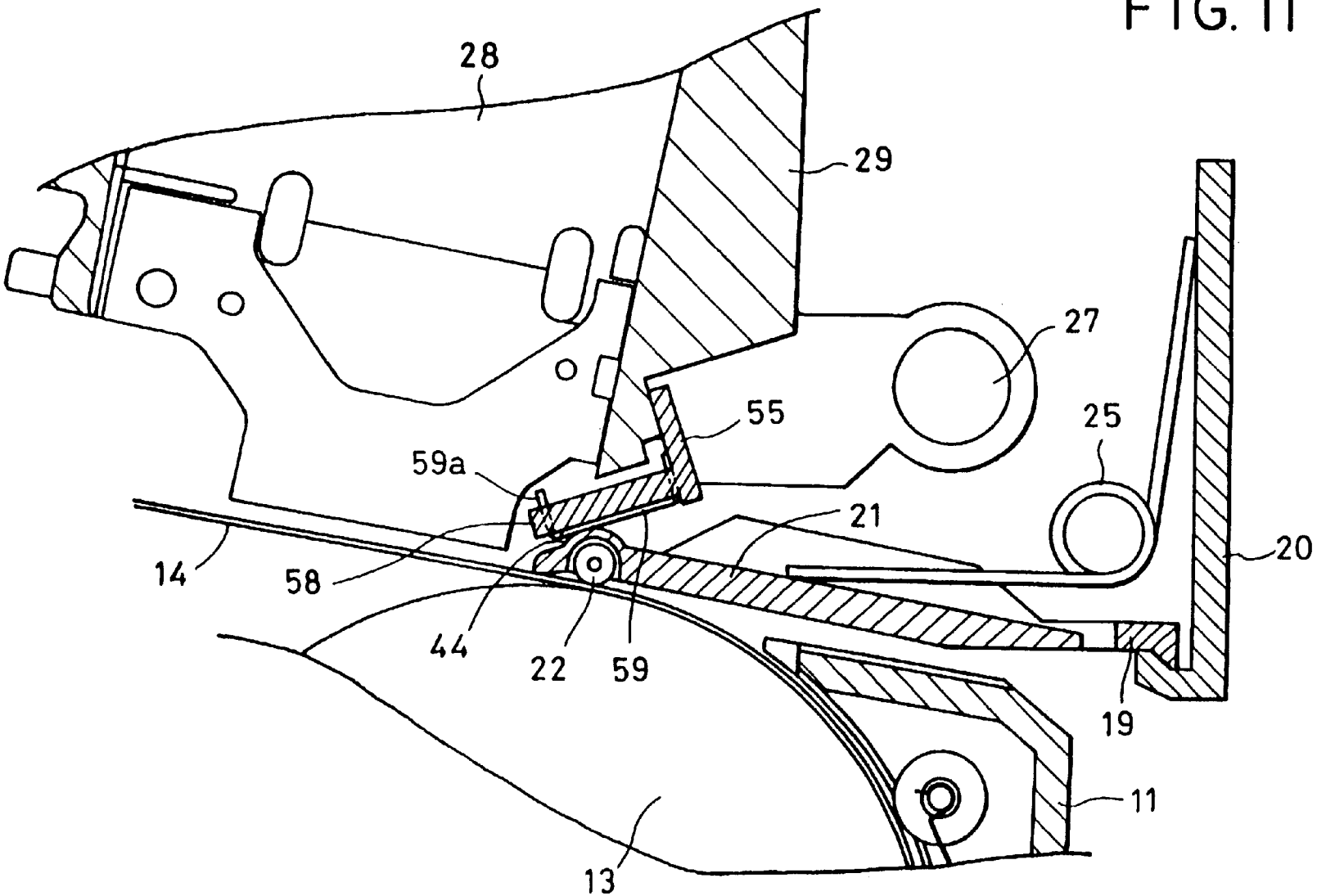
FIG. 11 is a cross-sectional diagram illustrating the construction of the principal members of a printer apparataus according to yet another embodiment of the present invention.

Next, another embodiment will be described with reference to FIG. 11. In FIG. 11, the displacement lever 55, displacement shaft 58, and sliding plate 59 are used from the carriage 29 of an embodiment later-described with reference to FIG. 17, and the principal components thereof are the same as those described above. FIG. 11 is a cross-section view along the plane indicated by the arrows A and B in FIG. 17.

The sliding guide portion 44 is an arc plane of a constant curvature having an axis generally parallel to the transporting roller 13. Also, the displacement shaft 58 for the sliding plate 59 and the plane of the sliding plate 59 which slides against the sliding guide 44 are generally parallel to the arc plane of the sliding guide 44, and is of an inclined plane so that removal thereof from the guide shaft 27 in the direction of transporting of the printing medium 14 by means of the transporting roller 13 causes approaching thereof.

The operation of printing on printing medium 14 of different thicknesses with such a configuration will now be described. In the event that a printing medium thicker than that shown in the Figure is transported, the guide roller 22 and sliding portion 44 are pushed upward by an amount corresponding to the increased thickness. In accordance with this, the sliding plate 59, displacement lever 55, carriage 29, and printing head 28 integrally rotate to the right around the guide shaft 27. At this time, the amount of motion of the ink ejecting portion of the printer head is greater than that of the sliding plate 59 due to being farther from the guide shaft which is the center of rotation, i.e., the amount of motion of the head becomes greater than the change in thickness of the printing medium. Slanting the sliding plate 59 thus has the effect of relieving the phenomena of the extra movement of the printer head. That is, the greater the inclination is, the less movement there is in correspondence with change in the thickness of the printing medium. However, it is undesirable to make this inclination to be too great, as the printer head 28 moves vertically in the event that a positional margin of error of the sliding portion 44 occurs in the right or left directions in the Figure. Particularly, a 30° inclination such as described regarding the structure of the aforementioned FIG. 3, is preferable.

Next, description will be made regarding a structure to reduce irregularities in the running precision of the carriage even in cases wherein there are irregularities in height such as offset height in the carriage sliding portion of the member which supports and guides the carriage, or in cases wherein an offset occurs between the portion where the printing medium exists between the transporting roller and the medium pressing plate and where it does not exist between these members.

Figure 12:
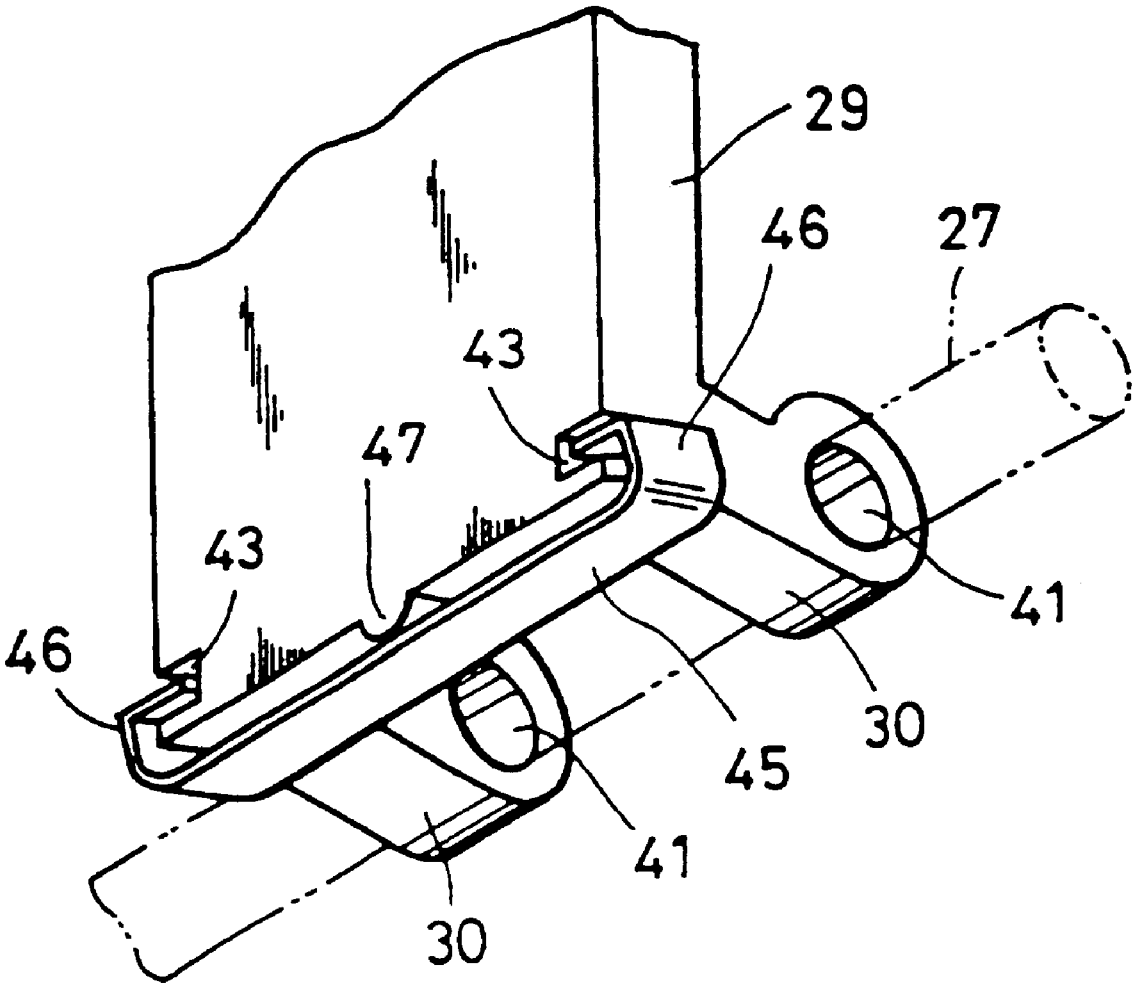
FIG. 12 is a perspective view of the carriage portion of a printer apparatus according to an embodiment of the present invention.

Provided integrally to the carriage 29 which detachably supports the printer head 28 so as to face the printing surface of the printing paper 14 upon the platen are a pair of brackets 30 protruding therefrom, these brackets protruding toward the guide shaft 27 and having round holes 41 therein whereby the guide shaft 27 can freely pass through, as shown in FIG. 12 illustrating the exterior of the bottom of the carriage 29.

On both sides of the bottom thereof following the scanning direction of the carriage 29 are formed retaining portions 43 in the form of cut-outs, and a pair of folded portions 46 are formed on both ends of the sliding plate 45 which comes into contact with the sliding guide portion 44 formed parallel with the transporting roller 13 in the leading upper plane of the aforementioned paper pressing plate 21, so as to be fitably retained to these retaining portions 43. Also, the fulcrum portion 47 protruding from the lower plane of the carriage 29 comes into contact with the center portion of the sliding plate 45 in the direction of scanning of the carriage 29. In other words, the sliding plate 45 formed of stainless steel or the like and extending in the scanning direction of the carriage 29 is supported by the retaining portions 43 of the carriage 29 via folded portions 36, and the folded portions 46 alternatively displace upwards and downwards within the retaining portion 43, centered around the fulcrum 47.

Further, as described above, the carriage 29 is linked rotatably to the guide shaft 27, and rotates so as to approach the platen side. As a result, the sliding plate 45 comes into contact with the sliding guide portion 44 of the paper pressing plate 21, and thus the head gap between the printing surface of the printing paper 14 and the printing head 28 is maintained at a constant. At the same time, the sliding plate 45 is in contact with the sliding guide portion 44 of the paper pressing plate 21, so that the sliding plate 45 follows the sliding guide portion 44 of the paper pressing plate 21 upon scanning motion of the carriage 29, in displacement the sliding plate 45 in accordance with the surface formation of this sliding guide portion 44.

Figure 13:
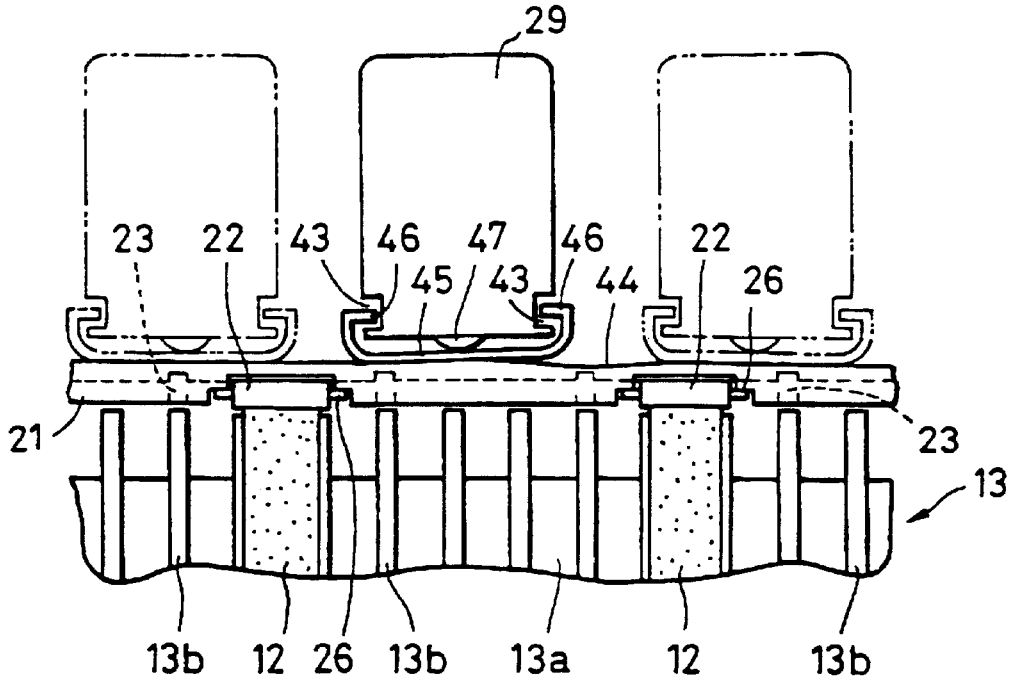
FIG. 13 is an operational conceptual diagram illustrating the scanning path of the carriage of the printer apparatus shown in FIG. 12.

For example, as shown in FIG. 13 illustrating the moving path of the carriage 29 in the case wherein the surface of the sliding guide portion 44 of the paper pressing plate 21 is undulated, in the case where the cycle of undulation on the surface of the sliding guide 44 is approximately the same as the length of the flat portion of the sliding plate 45 in the direction of scanning of the carriage 29, the carriage 29 does not sink to the bottom of the concave portions of the undulation on the surface of the sliding guide portion 44, and the vertical movement of the center of gravity of the carriage 29 is suppressed. In practical use, so long as the cycle of undulation on the surface of the sliding guide portion is ½ or less than the length of the flat portion of the sliding plate 45, the carriage 29 does not move vertically, and the head gap can be maintained constant.

Figure 14:
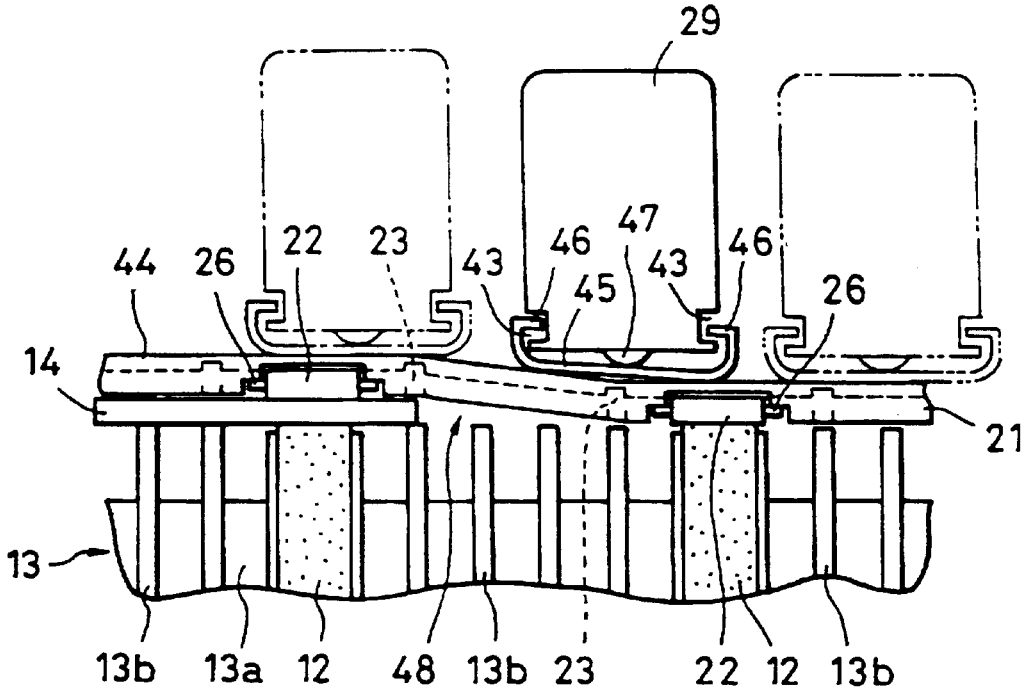
FIG. 14 is a operational conceptual diagram illustrating the scanning path of the carriage of the printer apparatus shown in FIG. 12, wherein printing medium exists between the transporting roller and the medium pressing plate.

Further, as shown in FIG. 14 which illustrates the state of printing work conducted on heavy printing paper 14 which is narrower that the width of the paper pressing plate 21, an offset portion 48 is generated between the portion pinching the printing paper 14 and the portion that is not. Now, when the carriage 29 moves from the right side to the left side in the Figure, the sliding plate 45 is inclined so as to follow the surface of the sliding guide portion 44 of the sliding plate 45, thus the shock generated upon the carriage 29 entering the offset portion 48 is extremely small, thereby assuring running stability of the carriage 29.

By means of forming both sides of the flat portion connected to the folded portions 46 of the sliding plate 45 so as to be an arc of a certain curvature, the catching of the sliding plate 45 on the sliding guide portion 44 of the sliding plate can be prevented beforehand, thus allowing for smooth sliding. From such a perspective, it is effective to form the sliding plate 45 of a material with a low friction coefficient, such as fluororesin.

Although the above embodiment has been described with the fulcrum 47 protruding from the bottom plane of the carriage 29, this may be formed to the side to the sliding plate 45.

Figure 15:
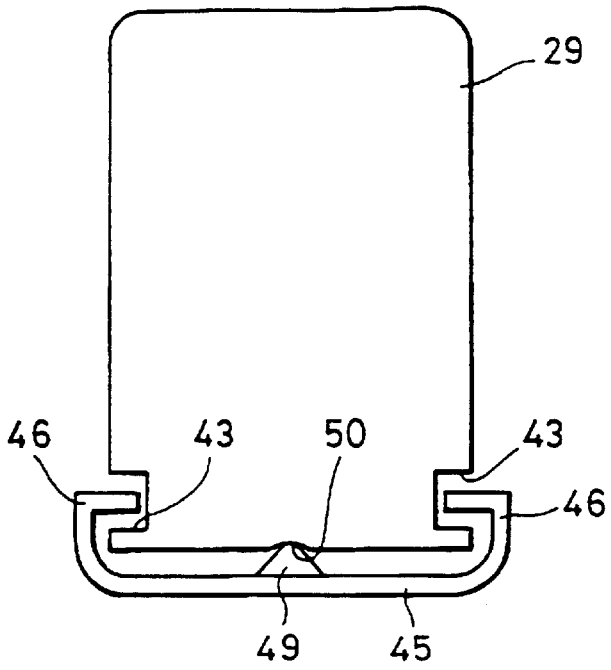
FIG. 15 is a frontal view of the exterior of the carriage in yet another embodiment according to the present invention.

The exterior view of a carriage of another such embodiment is shown in FIG. 15. The members which are of the same function as those of the earlier embodiments are denoted by the same reference numerals, and redundant description thereof will be omitted. i.e., a fulcrum portion 49 which protrudes downward to the side to the bottom plane of the carriage 29 is formed integrally to the center portion of the flat portion of the sliding plate 45 in the direction of scanning of the carriage 29. The upper tip of this fulcrum portion 49 is retained by a retaining concave portion 50 formed in the bottom plane of the carriage 29. The fulcrum portion 49 can be manufactured by means of press-forming of the sliding plate .45, or may be formed by adhesion of a separate member. The operation thereof is the same as the above-described embodiments shown in FIGS. 12 through 14 in that the sliding plate 45 displaces centrally around the fulcrum portion 49.

In the embodiments shown in FIGS. 12 through 14, a printer head 28 is mounted to the carriage 29 and the sliding plate 45 of the carriage 29 comes into contact with the sliding guide portion 44 of the paper pressing plate 21, thus providing the head gap accurately, but this head gap can be arranged so as to be capable of fine adjusting.

Figure 16:
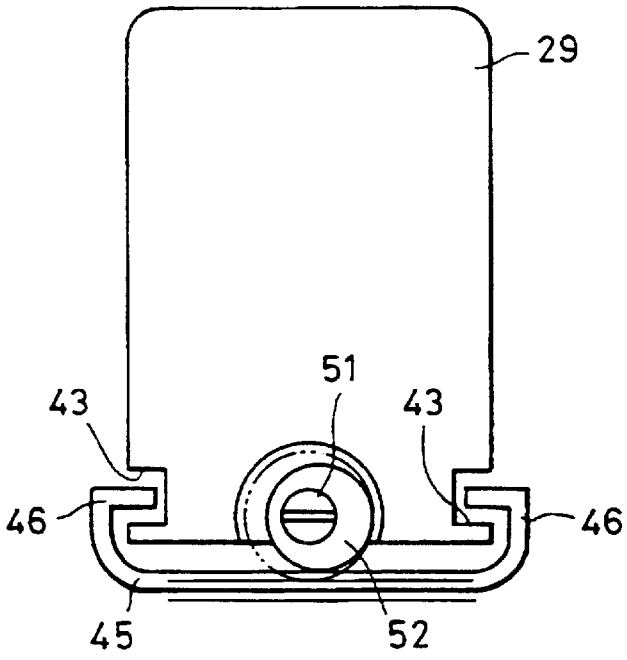
FIG. 16 is a frontal view of the exterior of another embodiment of a carriage in yet another embodiment according to the present invention.

The exterior view of a carriage of yet another such embodiment is shown in FIG. 16. The members which are of the same function as those of the earlier embodiments are denoted by the same reference numerals, and redundant description thereof will be omitted. An eccentric ring is rotatably attached to the bottom portion of the carriage 29 via a ring fixing screw 51 which extends in a direction parallel to the surface of the platen and at right angles to the direction of scanning of the carriage 29. This eccentric ring 52 is fit in an eccentric manner to the ring fixing screw 51, and the eccentric ring 52 can be fixed by means of operating the ring fixing screw 51 at a desired rotation position to the carriage 29. The lower edge of the eccentric ring 52 is located further lower than the lower bottom plane of the carriage 29, and thus the position of the flat portion of the sliding plate 45. can be finely adjusted in the upward and downward directions corresponding to the eccentricity of this eccentric ring 52.

The lower edge of the eccentric ring 52 also serves as a fulcrum in the present invention, and is precisely the same as the earlier embodiment in that the sliding plate 45 displaces centrally around the lower edge of this eccentric ring 52.

Figure 17:
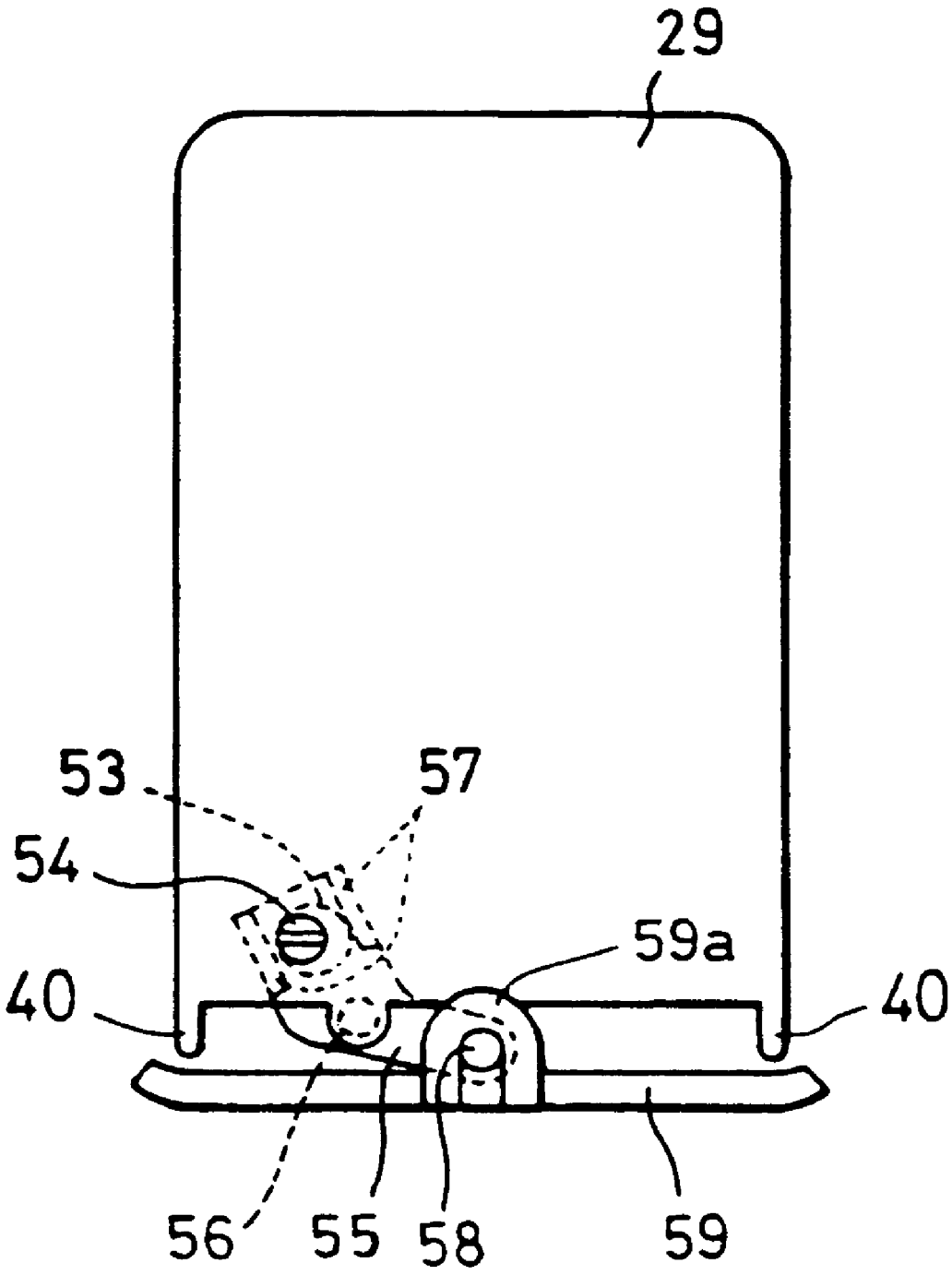
FIG. 17 is a frontal view of the exterior of yet another embodiment according to the present invention.

Next, yet another embodiment according to the present invention will be describe with reference to FIG. 17. The exterior view of a carriage 29 is shown in FIG. 17. The members which are of the same function as those of the earlier embodiments are denoted by the same reference numerals, and redundant description thereof will be omitted. Reference numeral 53 denotes an eccentric pin, and the smaller circumference portion 54 which is eccentric as compared to the larger circumference portion is rotatably fit to the lower portion of the carriage 29. The eccentric pin 53 can be fixed at a desired eccentric rotation position. Reference numeral 55 denotes an displacement lever, which is capable of displacement centrally around 56*a* to the carriage 29, with a pair of ribs 57 provided on one side pinching the greater circumference portion of the eccentric pin 53 and thus fixing to the position shown in the Figure. Further, a shaft 58 is provided to the other edge of the displacement lever 55. Reference numeral 59 denotes a sliding plate, but unlike the earlier embodiments, is rotatably fit to the shaft 58 of the aforementioned displacement lever 55 at the center portion 59*a*. Also, the folded portions 46 (FIG. 16) on both sides of the sliding plate 59 are done away with, with an extended portion 40 extended from the carriage 29 to the proximity of the sliding plate 59, thus restricting the amount of displacement of the sliding plate 59. In the above construction, rotating the eccentric pin 53 causes synchronous displacement of the displacement lever 55, thus the position of the flat portion of the sliding plate 59 can be finely adjusted in the upward and downward directions. Consequently, the spacing between the sliding plate 59 and the carriage extended portion 40 can be changed, so that the range of adjustment in the upward and downward directions of the sliding plate 59 can be adjusted.

According to the printer apparatus of the present invention, even in the case where the printing medium pressing member has been constructed so as to be easily flexible in the width direction of the printing medium in order to make the pressure from the printing medium pressing member to the printing medium uniform, the sliding portion of the carriage has been made so as to displace in accordance with the surface form of the printing medium pressing member, so that even if there is existence of fine undulations on the surface of the printing medium pressing member the amplitude thereof is reduced, and the shock of riding up on the offset portion generated on the surface of the printing medium pressing member based on the edge of the printing medium is weakened, thus allowing for the scanning precision of the carriage to be maintained favorably.

Also, the sliding plate turns following the surface form of the medium pressing plate, so that there is no uneven contact of the sliding plate, thus inhibiting uneven wearing of the sliding plate.

Further, in the event that the position of the sliding plate to the carriage is made to be movable, adjustment of the head gap can be performed easily.

What is claimed is:

1. A printer apparatus comprising:

a printing medium supporting member which supports a printing medium;

a printing medium pressing member which is provided across from and opposing said printing medium supporting member and being changeable in position and pressed toward said printing medium supporting member to press the printing medium against said printing medium supporting member;

a carriage which scans in a direction of scanning along a width direction of the printing medium maintained between said printing medium supporting member and said printing medium pressing member, and which is provided movably in a direction away from said printing medium supporting member and pressed to a side of said printing medium pressing member so as to have one end of said carriage pressed against one surface of said printing medium pressing member opposite to another surface facing said printing medium supporting member; and a sliding portion in contact slidably with said one surface of said printing medium pressing member, said sliding portion retained at both ends to said one end of said carriage, and wherein both ends of the sliding portion are displaceable relative to said carriage in accordance with a surface form of said printing medium pressing member.

2. A printer apparatus according to claim 1, further comprising fulcrum adjusting means for changing a position of a displacement fulcrum of said sliding portion following a direction opposing said printing medium pressing member.

3. A printer apparatus according to claim 2, wherein said fulcrum adjusting means comprises:

a supporting shaft for supporting a central portion of said sliding plate;

an eccentric shaft which is mounted in an eccentric manner to a shaft supported by said carriage and wherein an outer circumference of said eccentric shaft contacts said carriage; and means for fixing said eccentric shaft to one of plural rotational positions.

4. A printer apparatus according to claim 1, wherein said sliding portion comprises:

a pair of retaining portion formed on both sides of said carriage in the direction of scanning;

a sliding plate having two ends fitting to said pair of retaining portions; and a fulcrum protruding from a center portion of said sliding plate and contacting said carriage.

5. A printer apparatus according to claim 1, wherein said sliding portion comprises:

a pair of retaining portions formed on both sides of said carriage in the direction of scanning;

a sliding plate having two ends fitting to said pair of retaining portions; and a fulcrum protruding from said one end of said carriage, and contacting a center portion of said sliding plate.

6. A printer apparatus according to claim 5, further comprising fulcrum adjusting means for changing a position of a displacement fulcrum of said sliding portion following a direction opposing said printing medium pressing member, said fulcrum adjusting means comprising:

a supporting shaft attached to said carriage; and an eccentric shaft which is mounted in an eccentric manner to said supporting shaft, and wherein the outer circumference of said eccentric shaft contacts the center portion of said sliding plate, and said eccentric shaft is capable of being fixed to one of plural rotational positions.

7. A printer apparatus according to any of claims 1 through 6, wherein said carriage is provided rotatably to and slidably along a guide shaft with a round cross-sectional formation, said guide shaft being parallel to a rotational shaft of a transporting roller comprising said printing medium supporting member.

8. A printer apparatus according to claim 7, wherein said guide shaft is provided above said medium pressing member, weight of said carriage causing said sliding portion to come into contact with said one surface of said medium pressing member.

9. A printer apparatus according to any one of claims 1 through 6, wherein said carriage is mounted with an ink-jet head which ejects ink toward a printing surface of the printing medium.

10. A printer apparatus according to claim 9, wherein said ink-jet head further comprises electro-thermal converting means for generating thermal energy to be used as energy for ejecting the ink.

11. A printer apparatus according to claim 9, wherein said ink-jet head further comprises electro-mechanical converting means for generating energy for ejecting the ink.

12. A printer apparatus, comprising:

a carriage for causing reciprocal movement of a printer head;

a carriage supporting member which slidably supports said carriage and guides movement of said carriage, said carriage supporting member further comprising a sliding supporting member which slidably supports said carriage; and displacement means, which is provided at said carriage, for displacing a surface of said sliding supporting member in a direction crossing a movement direction of said carriage, said displacement means comprising displacement center adjustment means for changing a displacement center of said displacement means.

13. A printer apparatus according to claim 12, wherein said printer head comprises an ink-jet head which ejects ink from ink discharging orifices.

14. A printer apparatus according to claim 13, wherein said printer head further comprises electro-thermal converting means for generating thermal energy for ejecting the ink.

15. A printer apparatus according to claim 13, wherein said printer head further comprises electro-mechanical converting means for generating energy for ejecting the ink.

16. An apparatus providing a carriage which causes a reciprocal movement of a head member along a sheet member, comprising:

a platen supporting the sheet member in a position opposite to the carriage;

a carriage moving mechanism supporting said carriage for possible displacement in a direction close to or far away from the platen, and causing a movement over regions where said sheet member is supported and said sheet member is not supported on the platen;

a sliding plate provided along a direction of the reciprocal movement of said carriage in a part of said carriage opposite to said platen, wherein the sliding plate comprises a sliding surface opposite to said sheet member supported on said platen and said carriage presses said sheet member or said platen via the sliding surface;

a holding mechanism holding the sliding plate to said carriage by retaining the ends of the sliding plate in order to make possible displacement in the direction to be close to/far away from said platen of both ends of said sliding plate in the direction of reciprocal movement of said carriage, wherein said holding mechanism comprises a fulcrum to displace one end side of the sliding plate in a direction opposite to said displacement direction of the other end side of the sliding plate when said both ends of the sliding plate are displaced in the direction to be close to/far away from said platen.

17. An apparatus according to claim 16, further comprising fulcrum adjusting means for changing a position of the fulcrum.

18. An apparatus according to claim 17, wherein said fulcrum position adjustment means comprises:

a supporting shaft for supporting a central portion of s aid sliding plate;

an eccentric shaft mounted in an eccentric manner to a shaft supported by said carriage and wherein an outer circumference of said eccentric shaft contacts said carriage; and means for fixing said eccentric shaft to one of plural rotational positions.

19. An apparatus according to claim 16, wherein the holding mechanism comprises a pair of retaining portions formed on both sides of said carriage in the direction of reciprocal movement, wherein the ends of the sliding plate are capable of fitting to said pair of retaining portions, and the fulcrum protrudes from a center portion of said sliding plate and contacts said carriage.

20. An apparatus according to claim 16, wherein said holding mechanism comprises a pair of retaining portions formed on both sides of said carriage in the direction of reciprocal movement, wherein the ends of the sliding plate are capable of fitting to said pair of retaining portions, and the fulcrum protrudes from one end of said carriage and contacts a center portion of said sliding plate.

21. An apparatus according to claim 20, further comprising fulcrum position adjustment means for changing a position of the fulcrum including:

a supporting shaft attached to said carriage; and an eccentric shaft which is mounted in an eccentric manner to said supporting shaft, and wherein the outer circumference of said eccentric shaft contacts the center portion of said sliding plate, and said eccentric shaft is capable of being fixed to one of plural rotational positions.

22. An apparatus according to any of claims 17 through 21, wherein said carriage is provided rotatably to and slidably along a guide shaft with a round cross-sectional formation, said guide shaft being parallel to a rotational shaft of a transporting roller comprising said platen.

23. An apparatus according to claim 22, wherein said guide shaft is provided above said sheet member or said platen, the weight of said carriage causing said sliding plate to come into contact with one surface of said sheet member or said platen.

24. An apparatus according to any one of claims 17 through 21, wherein said carriage is mounted with an ink-jet head which ejects ink toward a printing surface.

25. An apparatus according to claim 24, wherein said ink-jet head further comprises electro-thermal converting means for generating thermal energy to be used as energy for ejecting the ink.

26. An apparatus according to claim 24, wherein said ink-jet head further comprises electro-mechanical converting means for generating energy for ejecting the ink.

* * * * *

UNITED STATES PATENT AND TRADEMARK OFFICE

CERTIFICATE OF CORRECTION

PATENT NO. : 6,250,731 B1
DATED : June 26, 2001
INVENTOR(S) : Hashimoto

It is certified that error appears in the above-identified patent and that said Letters Patent is hereby corrected as shown below:

Column 1,
Line 33, "thereafter" should read -- (hereafter --.
Line 59, "unto" should read -- to --.

Column 2,
Line 31, "the-left" should read -- the left --.

Column 3,
Line 35, "member" should read -- member and --.
Line 54, "a operational" should read -- an operational --.

Column 4,
Line 27, "a operational" should read -- an operational --.
Line 57, "and-a" should read -- and a --.
Line 61, "to the" should read -- to --.

Column 5,
Line 59, "the-carriage" should read -- the carriage --.

Column 6,
Line 12, "extend" should read -- extended --.

Column 8,
Line 1, "10" should read -- 10. --.
Line 12, "extend" should read -- extended --.
Line 28, "of the" (second occurrence) should be deleted.

Column 10,
Line 7, "portion" should read -- portion 44 --.

Column 11,
Line 14, "describe" should read -- described --.

Column 12,
Line 45, "portion" should read -- portions --.

Column 13,
Line 13, "weight" should read -- the weight --.

UNITED STATES PATENT AND TRADEMARK OFFICE

CERTIFICATE OF CORRECTION

PATENT NO. : 6,250,731 B1
DATED : June 26, 2001
INVENTOR(S) : Hashimoto

It is certified that error appears in the above-identified patent and that said Letters Patent is hereby corrected as shown below:

Column 14,
Line 15, "s aid" should read -- said --.

Signed and Sealed this

Twenty-sixth Day of March, 2002

*Attest:*

*Attesting Officer*

JAMES E. ROGAN
*Director of the United States Patent and Trademark Office*